US009562391B2

(12) United States Patent
Pennacchioli et al.

(10) Patent No.: US 9,562,391 B2
(45) Date of Patent: Feb. 7, 2017

(54) DRIVING HEAD FOR TELESCOPIC DRILL RODS AND MACHINE COMPRISING SAID HEAD

(75) Inventors: Marcello Pennacchioli, Ancona (IT); Luca Urbani, Montefano (IT)

(73) Assignee: I.M.T. INTERNATIONAL S.P.A., Rome (IT)

( * ) Notice: Subject to any disclaimer, the term of this patent is extended or adjusted under 35 U.S.C. 154(b) by 480 days.

(21) Appl. No.: 14/130,996

(22) PCT Filed: Jul. 5, 2012

(86) PCT No.: PCT/EP2012/063182
§ 371 (c)(1),
(2), (4) Date: Jan. 6, 2014

(87) PCT Pub. No.: WO2013/007609
PCT Pub. Date: Jan. 17, 2013

(65) Prior Publication Data

US 2014/0138113 A1 May 22, 2014

(30) Foreign Application Priority Data

Jul. 14, 2011 (IT) ..... AN2011A0097

(51) Int. Cl.

| | |
|---|---|
| ***E21B 3/00*** | (2006.01) |
| ***E21B 33/04*** | (2006.01) |
| ***E21B 19/14*** | (2006.01) |
| ***E21B 19/15*** | (2006.01) |
| ***E21B 19/083*** | (2006.01) |
| ***E21B 3/04*** | (2006.01) |

(52) U.S. Cl.
CPC ..... *E21B 3/045* (2013.01)

(58) Field of Classification Search
USPC ..... 173/150
See application file for complete search history.

(56) References Cited

U.S. PATENT DOCUMENTS 3,802,260 A * 4/1974 Kishel ..... E21B 21/08 73/152.04

* cited by examiner

*Primary Examiner* — Michelle Lopez
(74) *Attorney, Agent, or Firm* — Egbert Law Offices, PLLC

(57) ABSTRACT

A driving head for telescopic drill rods has a frame, a cylindrical collar rotatably coupled with said frame, and provided at least with one internal surface comprising at least one driving rack adapted to be coupled with corresponding driven racks of telescopic drill rods, and actuation means to drive said cylindrical collar into rotation, said driving rack being coupled with said cylindrical collar by means of removable connection means. A machine provided with said driving head is also disclosed.

7 Claims, 4 Drawing Sheets

DRIVING HEAD FOR TELESCOPIC DRILL RODS AND MACHINE COMPRISING SAID HEAD

CROSS-REFERENCE TO RELATED U.S. APPLICATIONS

Not applicable.

STATEMENT REGARDING FEDERALLY SPONSORED RESEARCH OR DEVELOPMENT

Not applicable.

NAMES OF PARTIES TO A JOINT RESEARCH AGREEMENT

Not applicable.

REFERENCE TO AN SUBMITTED ON COMPACT DISC

Not applicable.

BACKGROUND OF THE INVENTION

1. Field of the Invention

The present patent application for industrial invention relates to a driving head for telescopic drill rods and to a machine comprising said head.

2. Description of Related Art Including Information Disclosed Under 37 CFR 1.97 and 37 CFR 1.98.

Several drilling techniques are known in the state of the art; one of them provides for using a rotary drilling tool mounted at the end of a set of telescopic rods and is usually defined as rotary technique.

Rods are driven into rotation by a driving head operatively connected with a machine; by means of suitable driving means the driving head drives said rods into rotation around their axis, in such manner to transmit motion to the tool mounted at the end of the head rod.

According to such technique, an axial thrust must be sometimes transmitted to the tool or rods, in addition to a rotary momentum.

In order to guarantee a suitable axial thrust for a series of different operations, some telescopic rods are provided with a special internal and external rack distinguished by the particular shape of the teeth.

Such a solution is disclosed in the European patent application EP 0 335 059 in the name of the same applicant.

In brief, said telescopic rods comprise automatic coupling racks, wherein the teeth comprise at least one intermediate section extending in orthogonal direction to the axis of rotation and coinciding with the direction of the vector of the force applied in case of axial thrust or traction.

The driving head of the machine adapted to transmit the momentum and axial force to said telescopic rods comprises a frame to which a cylindrical collar is revolvingly associated, being internally provided with driving racks adapted to engage with the driven racks preach rod to transmit both the angular momentum and the axial force (either thrust or traction).

For this reason, the driving racks and the driven racks are complementary and are provided with complementary teeth for mutual engagement.

The Applicant has noted that, in spite of being an excellent solution, such a solution is impaired by some drawbacks.

The driving racks, which are obtained, in one piece with the cylindrical collar in such manner to protrude from its internal surface, are subject to high wear, both for the considerable loads involved, and for the fact that their use is higher than the driven racks.

In spite of being an excellent solution in terms of resistance, such a solution is impaired by the fact that the replacement of the driving racks is a rather long and difficult operation.

As a matter of fact, some material must be provided, for example by means of welding with a suitable template, to restore the correct shape of the teeth. Such an operation is a long and difficult operation.

Moreover, it was noted that teeth repaired in this way are subject to higher wear compared to new teeth, thus causing the early wear of the driven racks of the rods.

After some studies the Applicant has discovered that the latter drawback is caused by the natural welding shrinkage that may alter, in some cases, the profile of the tooth, when the material has deposited.

Because of the level of the existing forces, if the profiles of the driven teeth and the driving teeth do not have a high level of conjugation, high wear is generated between the parts, thus causing not only the dissipation of mechanical energy and the general heating of the driving head, but also the early wear of the driving and/or driven teeth, according to the specific case.

In other words, the technique that is currently used to repair the teeth of racks originates three types of drawbacks:

- difficulty to obtain the best profile in terms of engagement;
- difficulty in the repair operation;
- excessive overheating attributable not so much to the dissipation of mechanical energy, but to the fact that in the repair operation of the tooth by means of welding, some material is melt, with consequent change of the mechanical properties of the cylindrical collar and potential damage of seals and bearings connecting the collar to the frame of the driving head.

DE 40 38 424 discloses a Kelly borehole drilling arrangement provided with a rotating drill head coupled with telescopic pipes. The outermost Kelly pipe extends below the drill head and remains in rotary connection with the transmission piece.

The purpose of the present invention is to provide a driving head for telescopic rods able to solve the problems of the prior art.

These purposes are achieved by the present invention according to the first attached claim.

SUMMARY OF THE INVENTION

The applicant has devised a driving head for telescopic drill rods wherein the cylindrical collar is provided with at least one internal surface comprising at least one driving rack coupled with the cylindrical collar with removable connection means, preferably of screw type.

More precisely, the racks are fixed to the cylindrical collar by means of screws, although mechanical centering means are also provided to withstand the stress suffered by the rack.

In this way, the replacement of the driving racks is simple and fast, without the aforementioned problems related to welding shrinkage. In fact, when the first wear signs appear, the driving racks (limitedly to the ones that are actually worn out) can be dismounted and replaced with new driving racks, thus maintaining the ideal coupling with the driven racks.

Moreover, the models of drill rods can be changed (for example, with rods having racks with a different shape) without changing the entire driving head, by simply changing the cylindrical collar.

The present invention also comprises additional ameliorative characteristics, which are the object of the attached dependent claims.

An additional purpose of the present invention is a machine provided with a driving head according to the present invention.

BRIEF DESCRIPTION OF THE SEVERAL VIEWS OF THE DRAWINGS

For explanatory reasons, the description of the invention continues with reference to attached drawings, which only have an illustrative, not limiting value, wherein.

DETAILED DESCRIPTION OF THE INVENTION

Figure 1:
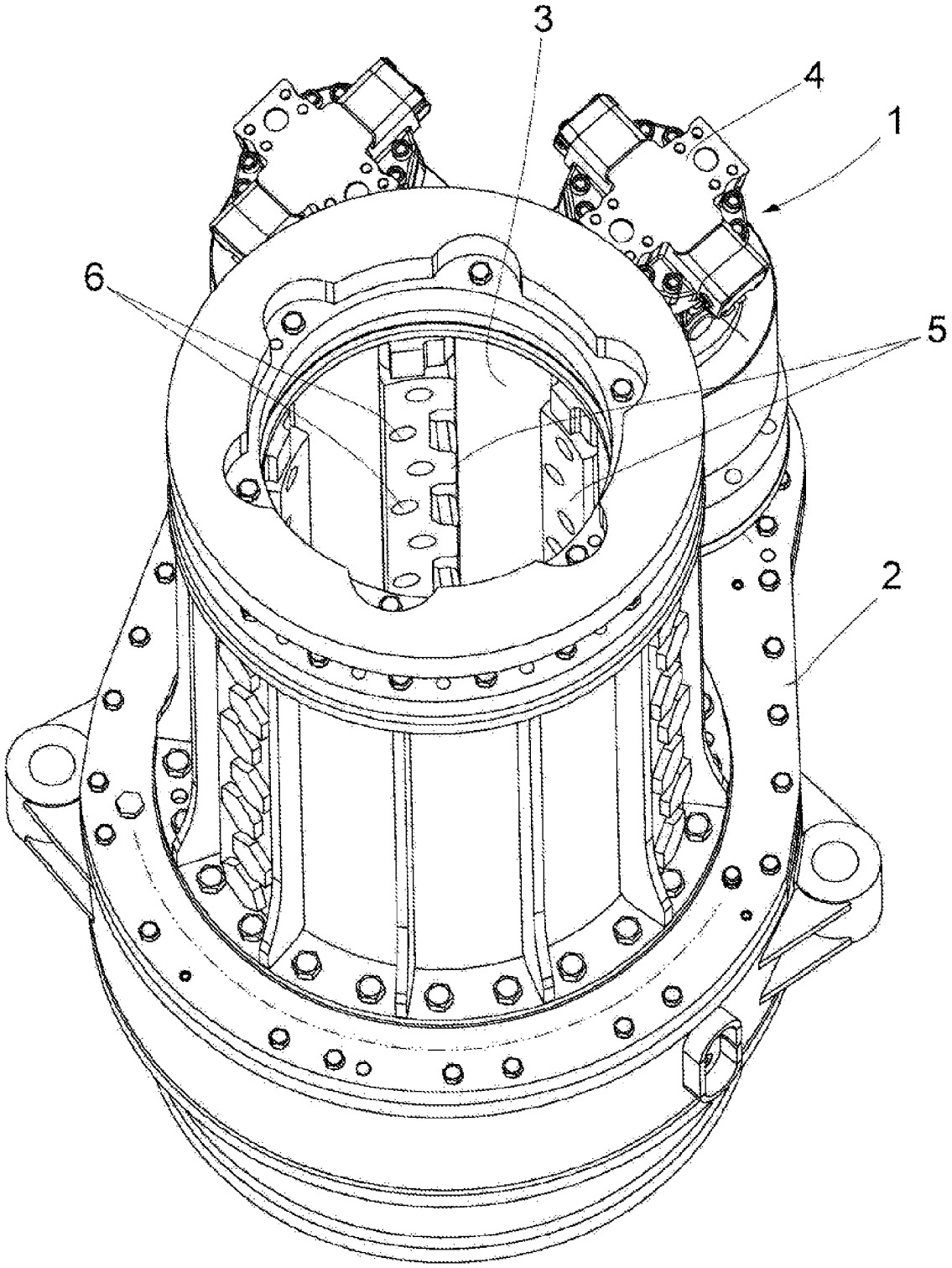
FIG. 1 is a perspective view of a driving head according to the present invention.
Figure 2:
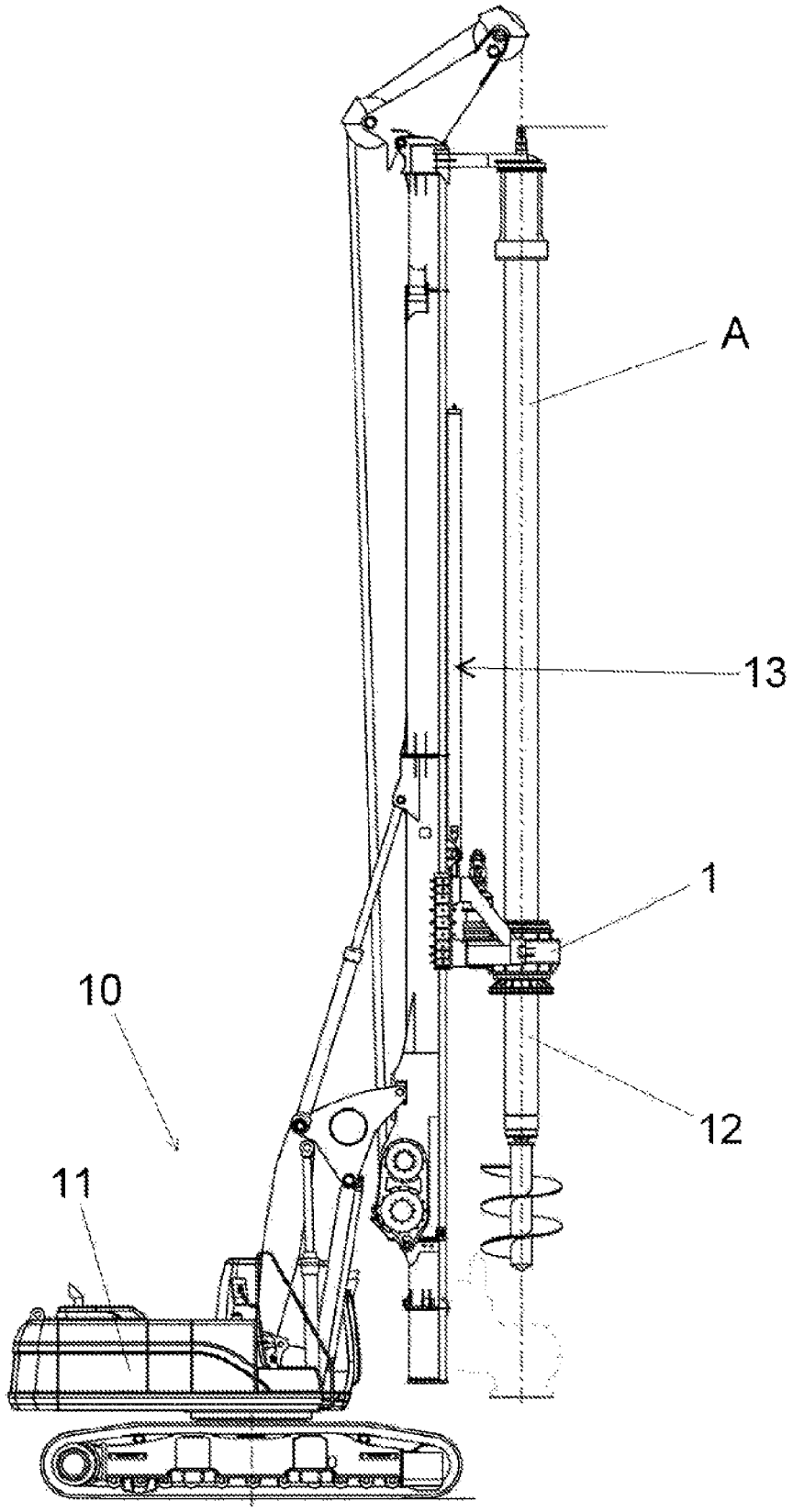
FIG. 2 is a machine provided with the head of FIG. 1.

Referring to FIGS. 1 and 2, a driving head (1) for telescopic drill rods (A) comprises a frame (2) and a cylindrical collar (3) rotatably coupled with said frame (2).

The cylindrical collar (3) is provided at least with one internal surface from which at least one driving rack (5) protrudes, being adapted to be coupled with corresponding driven racks of telescopic drill rods (A). The driven racks are realized according to the precepts of the European patent application EP 0 335 059.

Figure 3:
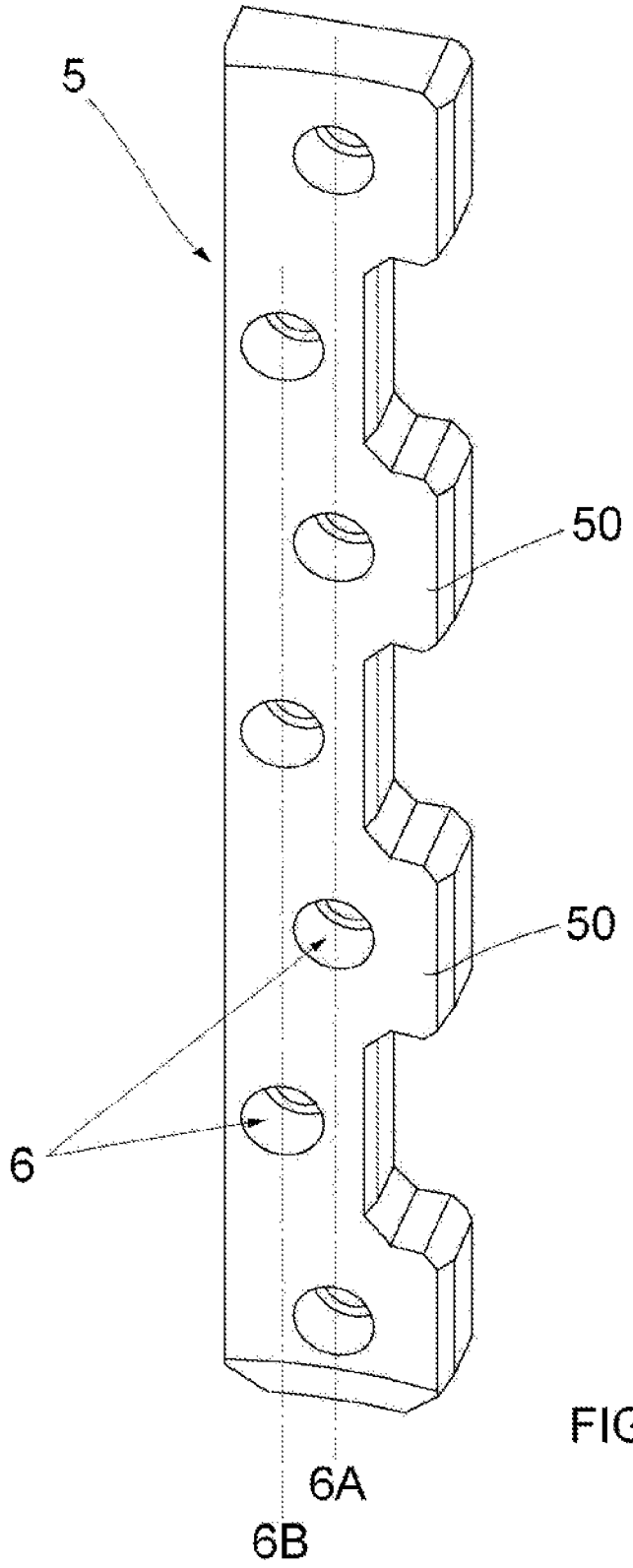
FIG. 3 is a detail of a rack section of the head of FIG. 1.

Likewise, the driving racks (5) have a complementary shape with respect to the driven racks and are therefore provided with teeth (50) with at least one intermediate section extending in orthogonal direction to the axis of rotation, as shown in FIG. 3.

Generally speaking, the precepts of the present invention may be used regardless of the shape of the tooth (50), which might simply have a wedge-like shape (without the aforesaid intermediate section). However, the best advantages are found in this application, which must be considered as preferential.

The collar (3) is driven into rotation around its axis with actuation means (4) that are preferably hydraulic actuation means.

In some embodiments, the actuation means (4) are associated with the frame (2) and also comprise hydraulic engines to transmit the angular momentum to the collar (3). According to other embodiments, the actuation means (4) are kinematic mechanisms that transmit the angular momentum to the collar (3), whereas the engines are housed on the machine (10).

The frame (2) is slidingly coupled with a rectilinear track (12) to determine a linear movement of said actuation head (1) along the direction of the track (12) parallel to the axis of rotation of the collar (3) to transmit an axial force, either a thrust force or a traction force, to the rods (A), according to the specific requirements.

The movement of the frame (2) along the track (12) is controlled by driving means (13), for example hydraulic cylinders.

Going back to the driving rack (5), as shown in the example, the collar (3) has a plurality of racks (5) protruding from its internal surface.

The number and angular position of said driving racks (5) vary according to the needs and can be chosen by the expert of the field without any inventive effort.

Each driving rack (5) is coupled with the cylindrical collar (3) by means of removable connection means (6) that consist in screw connection means in the embodiment shown.

Moreover, mechanical centering means are provided, between rack and collar, thus contributing to withstand the existing forces.

Figure 4:
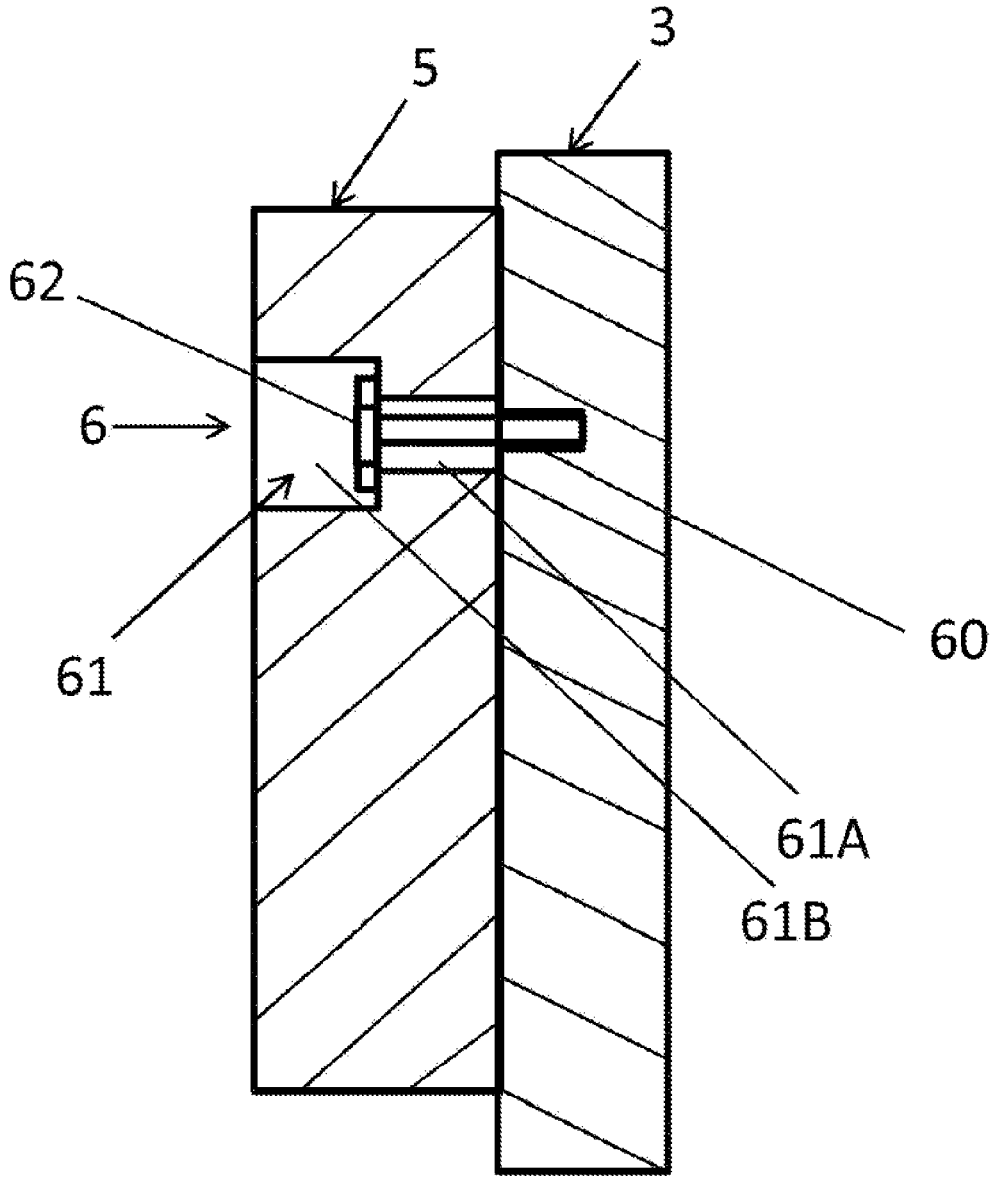
FIG. 4 is a partial cross-sectional view of the head of FIG. 1.

Now referring to FIG. 4, the removable screw connection means (6) comprise a threaded hole (60) obtained on the internal side of said collar (3), a housing (61) obtained in said driving rack (5), a bolt (62) with enlarged head adapted to be screwed into said threaded hole (60) and passing through said housing (61) to engage said driving rack (5).

More specifically, the housing (61) comprises a first section (61A) with first diameter that is open on one side of said driving rack (5) facing the internal surface of said collar (3).

Moreover, the housing (61) comprises a second section (61B) with second diameter that is open on one side of the driving rack (5) opposite to the side facing said internal surface of the collar (3).

The second diameter is at the same time higher than the first diameter and lower than the diameter of said enlarged head of said bolt (62), in such manner to obtain coupling by interference of shape, which is simple to realize and assemble.

In order to improve the mechanical resistance properties of the coupling between driving rack (5) and collar (3), given the existing forces, the removable connection means (6) are disposed at least in correspondence of the teeth (50) of each rack (5), as shown in FIG. 3.

Another advantageous characteristic in terms of sturdiness derives from the fact that a first (6A) and a second (6B) row of removable connection means (6) are provided.

For each row (6A, 6B) connection means (6) are disposed linearly.

A first row (6A) is in proximal position to the teeth (50) and is provided, with a removable connection means (6) in correspondence with each tooth (50).

Instead, the second row (6B) of removable connection means (6) is disposed in remote position to said teeth (50) and provided with a removable connection means (6) in correspondence of each valley between two adjacent teeth (50).

According to another embodiment, not shown in the attached figures, a stud-bolt is provided instead of the bolt (62), protruding from the internal surface of the collar and being inserted into the hole (61) to lock the driving rack (5) with a nut.

The operation principle and the spatial disposition of the removable screw connection means are similar to the ones described above, therefore omitting a detailed description.

According to another embodiment (not shown in the attached figures), the removable connection means are bayonet connection means, and not screw connection means, for instance with pins adapted to fix each driving rack (5) to the collar (3). In such a case, the pins are inserted by interference in the hole (60) of the collar (3) and engage the rack (5) in the same way.

Such a solution can be advantageously used because, during the various operating conditions, the pins are only subject to cutting forces, and not to a force along their extraction direction.

Moreover, another advantage of such a solution is that it is easy to install, although if additional difficulties are encountered to extract the pins with a suitable puller.

Furthermore, many additional variants are possible within the reach of an expert of the field in the light of the precepts herein disclosed, which are therefore to be considered as an integral part of the present invention.

The invention claimed is:

1. A driving head for a telescopic drill rod, the driving head comprising:

a frame;

a cylindrical collar rotatably coupled to said frame; and an actuator cooperative with said cylindrical collar so as to drive said cylindrical collar into rotation, said cylindrical collar having at least one internal surface having at least one driving rack adapted to be coupled to corresponding driven racks of the telescopic drill rod, the driving rack being coupled to said cylindrical collar by a removable connector, said removable connector comprising:

a threaded hole formed in the internal surface of said cylindrical collar;

a housing positioned in the driving rack; and a bolt with an enlarged head adapted to be screwed into said threaded hole and passing through said housing so as to engage the driving rack.

2. The driving head of said claim 1, said housing comprising a first section with a first diameter that is open on one side of the driving rack so as to face the internal surface of said cylindrical collar and a second section with a second diameter that is open on another side of the driving rack which is opposite to the one side facing said internal surface of said collar, the second diameter being greater than the first diameter and less than a diameter of said enlarged head of said bolt.

3. The driving head of said claim 1, the driving rack having a plurality of adjacent teeth, the removable connector being disposed so as to correspond with said plurality of adjacent teeth.

4. The driving head of said claim 3, the teeth of said plurality of adjacent teeth being separated by valleys, said removable connector comprising a first row of removable connectors linearly disposed proximal to said plurality of adjacent teeth and a second row of removable connectors linearly disposed distal to said plurality of adjacent teeth and in correspondence to the valley between a pair of the adjacent teeth.

5. The driving head of claim 1, the driving rack having teeth provided with at least one intermediate section that extends orthogonally to an axis of rotation of said cylindrical collar.

6. A machine having the driving head of claim 1.

7. The machine of claim 6, further comprising:

a rectilinear track to which said frame of the driving head is slidably coupled; and a driver slidably activating said frame along said rectilinear track.

* * * * *